US006176191B1

(12) United States Patent
Fernandes et al.

(10) Patent No.: US 6,176,191 B1
(45) Date of Patent: Jan. 23, 2001

(54) BILGE KEEL AND METHOD FOR FPSO PETROLEUM PRODUCTION SYSTEMS

(75) Inventors: Antonio Carlos Fernandes; Isaias Quaresma Masetti, both of Rio de Janeiro (BR)

(73) Assignee: Petroleo Brasileiro S.A., Petrobras (BR)

( * ) Notice: Under 35 U.S.C. 154(b), the term of this patent shall be extended for 0 days.

(21) Appl. No.: 09/262,911

(22) Filed: Mar. 5, 1999

(30) Foreign Application Priority Data

Mar. 6, 1998 (BR) ..... 9800843-

(51) Int. Cl.[7] ..... B63B 3/44
(52) U.S. Cl. ..... 114/142; 114/140; 114/141
(58) Field of Search ..... 114/142, 126, 114/140, 141, 230, 290; 405/195.1, 224

(56) References Cited

U.S. PATENT DOCUMENTS

| | | | | |
|---|---|---|---|---|
| 1,864,102 | * | 6/1932 | Telfer | 114/126 |
| 2,878,772 | * | 3/1959 | Kjekstad | 114/126 |
| 4,753,185 | * | 6/1988 | Salusbury-Hughes | 114/230 |
| 5,372,531 | * | 12/1994 | Boatman et al. | 114/230 |
| 5,425,325 | * | 6/1995 | Washio | 114/290 |
| 5,553,976 | * | 9/1996 | Korsgaard | 405/195.1 |
| 5,584,607 | * | 12/1996 | de Baan | 405/224 |

FOREIGN PATENT DOCUMENTS

| | | |
|---|---|---|
| 112 403 | 1/1918 | (GB) . |
| 501 081 | 3/1939 | (GB) . |
| 651 064 | 3/1951 | (GB) . |

OTHER PUBLICATIONS

Henschke W.; "Schiffbautechnisches Handbuch Band 1" 1961; Veb Berlag Technik, Berlin DD XP002108708 22717 1.872 Schlingerkiele; pp. 270–271.

Henschke W.; "Schiffbautechnisches Handbuch Band 2"1961; Veb Berlag Technik, Berlin DD XP002108709 22717 2.433.82 Schlingerkiele; p. 155.

Van Voorst O.et al; "Conversion of Existing Tanker to North Sea FPSO Use"; Annual Offshore Technology Conference, vol. 27, May 1–4, 1995, XP002108707 Houston, TX; PaPer OTC 7724; p. 304 lines 12–25.

Patent Abstract of Japan; vol. 010; No. 204 (M–499) Jul. 17, 1986; JP 61 046789.

Patent Abstract of Japan; vol. 004, No. 003 (M–087) Jan. 11, 1980; JP 54 138297.

* cited by examiner

*Primary Examiner*—S. Joseph Morano
*Assistant Examiner*—Lara A. Olson
(74) *Attorney, Agent, or Firm*—Nixon & Vanderhye PC

(57) ABSTRACT

This is a mechanical element intended to control the rolling of FPSO type petroleum production systems which use adapted decommissioned ships as the floating facility. The bilge keel is made up of two lines of plates, continuous or sectioned, in this case with a small separation between each two adjacent sections, mounted along the bilge of the ship, one on either side, at right angles to the hull, and characterized basically by being wider and having a greater total length than the conventional bilge keels used in ships.

14 Claims, 3 Drawing Sheets

BILGE KEEL AND METHOD FOR FPSO PETROLEUM PRODUCTION SYSTEMS

FIELD OF THE INVENTION

The present invention is in the field of submarine production of petroleum. More particularly, it is related to the adaptation of decommissioned ships for use in petroleum production in deep water, consisting in floating production systems, which are also known to specialists as FPSOs ("Floating Production, Storage and Offloading"). Even more particularly, it is related to a means of minimizing the negative effects of the transverse swaying, or roll, inherent in the ships, which are intensified when they are adapted for FPSOs.

BASIS OF THE INVENTION

There is at present a worldwide tendency to use so-called FPSOs as floating production systems in maritime oilfields. Because of their availability and economy, recently decommissioned ships have been used as floating platforms for the FPSOs, after the necessary adaptations. The main feature of the changes to these ships relates to the installation, usually in the bow, of a turret which is anchored at the bottom of the sea. By the use of bearings, the ship can rotate freely around the vertical axis of symmetry of the turret. One of the functions of the turret is to allow the transfer of fluids between the submarine production system, which is stationary, and the FPSO, which is floating and has mobility around the turret.

The decommissioned ships have an elongated shape for greater efficiency of sailing. This shape inherently provides the ability to damp longitudinal swaying movements, or pitching, i.e. rotational movements around a transverse horizontal axis which passes through the middle of the ship. The principal mechanism of this damping is connected to the ability to generate waves, in the longitudinal direction, which carry the energy of the damped swaying away from the ship.

However, the same thing does not happen with rolling or transverse swaying movement, i.e. rotational movement around a horizontal axis, now longitudinal, which passes through the central longitudinal plane of the ship. Owing to the elongated shape, when the ship rolls the generation of waves is negligible and the rolling movement, once initiated, continues for a long time, or, in other words, is not damped.

This problem is aggravated by the fact that the typical natural period of oscillation of the roll is close to the periods of oscillation associated with sea waves. This natural period of roll of the vessel is due to the distribution of the total inertia and the hydrostatic restoration, which is practically impossible to change unless the shape of the ship is radically changed.

As was to be expected, the counterproductive characteristics of the ships which show a tendency to roll, together with a low damping factor for this movement, are "inherited" by the FPSOs. In addition, the FPSOs, unlike the ships, which have manoeuvring systems, are generally passive and practically stationary. In ships which move it is always possible to choose a bearing relative to the waves such as to minimize the effect of the rolling. Similarly, in the case of the FPSOs, the articulation provided by the turret allows alignment relative to the dominant environmental force. However, when the environmental incidences are different, i.e. when the waves, wind and current have different directions, the ship may be badly positioned relative to the waves. One possible consequence would be excitation of the transverse swaying of sufficient severity to interfere with the performance of the processing plant situated on board the FPSO.

PRIOR ART

Maritime petroleum production, storage and offloading (FPSO) systems installed in adapted oil tankers fitted with permanent anchorage systems have been used for many years.

Such systems, however, are used in relatively calm sea conditions, owing to the difficulties of anchoring big ships in rougher sea conditions. The reduction in the price of petroleum, and greater knowledge of anchorage systems relevant to the project, together with greater experience and confidence in the use of such systems, has led recently to a greater tendency to use FPSQ type systems in more exposed locations. In these conditions one of the problems to be solved is the control of transverse swaying without imposing a heavy burden on the cost of the undertaking, or in other words retaining the approach of using adapted decommissioned ships as the basis for these systems.

The present trend with regard to the control of transverse swaying in FPSO type systems is simply to accept the situation existing before the decommissioning or change in the activity of the ship. The solutions available for the problem of rolling are thus the same as those used for ships which sail and are therefore generally unsuitable for FPSOs.

Basically there are two types of devices in use to counter transverse rolling. The first type, which is cheap and effective and is consequently used fairly widely, is the construction, in the bilge of the ship, of a mechanical element called a "bilge keel". This element comprises fixed perpendicular plates extending from the bilge of the ship. An extension of this idea is the use of flaps, or, in other words, small transverse wings, which are much shorter than the bilge keels and which act as an active controller by varying the angle of attack. Two other types of devices can also be mentioned: the stabilization tank and, in the same "passive stabiliser" family, the so-called U tube. In both cases the principle of operation is that of the "dynamic vibration absorber". In these cases, oscillatory masses are introduced in such a way that when they oscillate they make the ship practically stop.

The work presented by J. A. Pinkster and H. R. Luth in 1993, at the $25^{th}$ Offshore Technology Conference, "The Reduction of Low-Frequency Motion of Moored FPSO's", describes and analyzes the possibility of using an articulated blade, in the prow of the ship, creating a passive system for conversion of the energy of the incident water. In high wave conditions the blade produces thrusts of medium and low frequency which oppose the forces, produced by the waves, which tend to move the ship. However, such a system is not specifically intended for control of the transverse swaying movement, apart from being of more complex design than that of the present invention.

The conventional bilge keel consists basically of a certain number of flat plates, with sharp edges, placed at right angles to the hull, forming a kind of line on each of its sides, with separations, extending along the parallel middle body of the ship (the central region of the ship excluding the extreme bow and stern portions, presenting an approximately uniform cross-section, and which, for oil tankers, comprises about 80% of the length thereof, being less for other types of ships).

Conventionally, in order to ensure that the resistance to forward movement of the ship is not affected too much by the introduction of the bilge keels, an attempt is made to align them along the natural flow lines of the hull in motion. Moreover, the width thereof is just sufficient to guarantee the separation of the boundary layer, at the corner point of the flat plate, when the ship starts to roll. When rolling occurs, the bilge keel produces a contrary moment, of viscous origin, which is strongly influenced by the generation of vorticity.

In addition to this viscous effect there is another effect, a supporting effect, which appears when the ship has a forward speed. In this case, locally, in each bilge keel, when rolling commences, concomitantly, a relative angle of attack is created which produces a contrary dissipating moment, which is not negligible, and is essentially proportional to the forward speed. In order to increase the efficacy of this effect, the bilge keels are not usually made continuous. Thus the best construction, from the hydrodynamic point of view, consists of sectioned bilge keels, forming discontinuous stretches, along the length of the ship. The spacing between each stretch must be sufficient to increase the efficacy of the supporting effect.

The term "total bilge keel length" as used herein is intended to denote the sum of the lengths of the sections of one discontinuous bilge keel and the length of one continuous bilge keel.

It is important to note that when ships are used as floating bases for FPSOs, the viscous effect remains but is not accompanied by the supporting effect, at least not completely. This is due to the fact that the typical speeds of the sea currents are much lower than the typical cruising speeds of oil tankers. On the other hand, the viscous effect, from the point of view of an FPSO, is unnecessarily small because, as was pointed out earlier, the width of the bilge keel of ships which sail must be small so as not to significantly affect the resistance to propulsion.

SUMMARY OF THE INVENTION

The invention relates to a bilge keel, with special structural characteristics, to be used in FPSOs with the aim of reducing the rolling of the floating base of systems of this type. The bilge keel for FPSOs is preferably made up of two lines of plates, approximately identical, of greater width than those of conventional bilge keels, which are placed at right angles to the hull of the ship adapted for FPSO, along the bilge thereof, one on each side and extending for almost all the length thereof. These plates can be flat or corrugated, and either continuous, or discontinuous with a small spacing between two consecutive stretches. The main operational principle is that of offering sharp edges in the appropriate position so as to provoke the generation of vorticity and thus create amplified moments, proportional to the area of the plates, which help to damp the rolling of the FPSO.

Accordingly, the invention provides a method of adapting a decommissioned ship according to claim 1 and a bilge keel according to claim 8 of the appended claims.

The invention will now be further described, by way of example only, with reference to the accompanying drawings, in which.

DETAILED DESCRIPTION OF THE INVENTION

For a better understanding of the invention, it will be described with reference to the accompanying drawings. It must be stressed, however, that the Figures only illustrate one preferred embodiment of the invention, and do not therefore have a limiting nature. If the inventive concept hereinafter described is followed, the possibility of using different arrangements or additional devices will be clear to persons skilled in the art.

Figure 1:
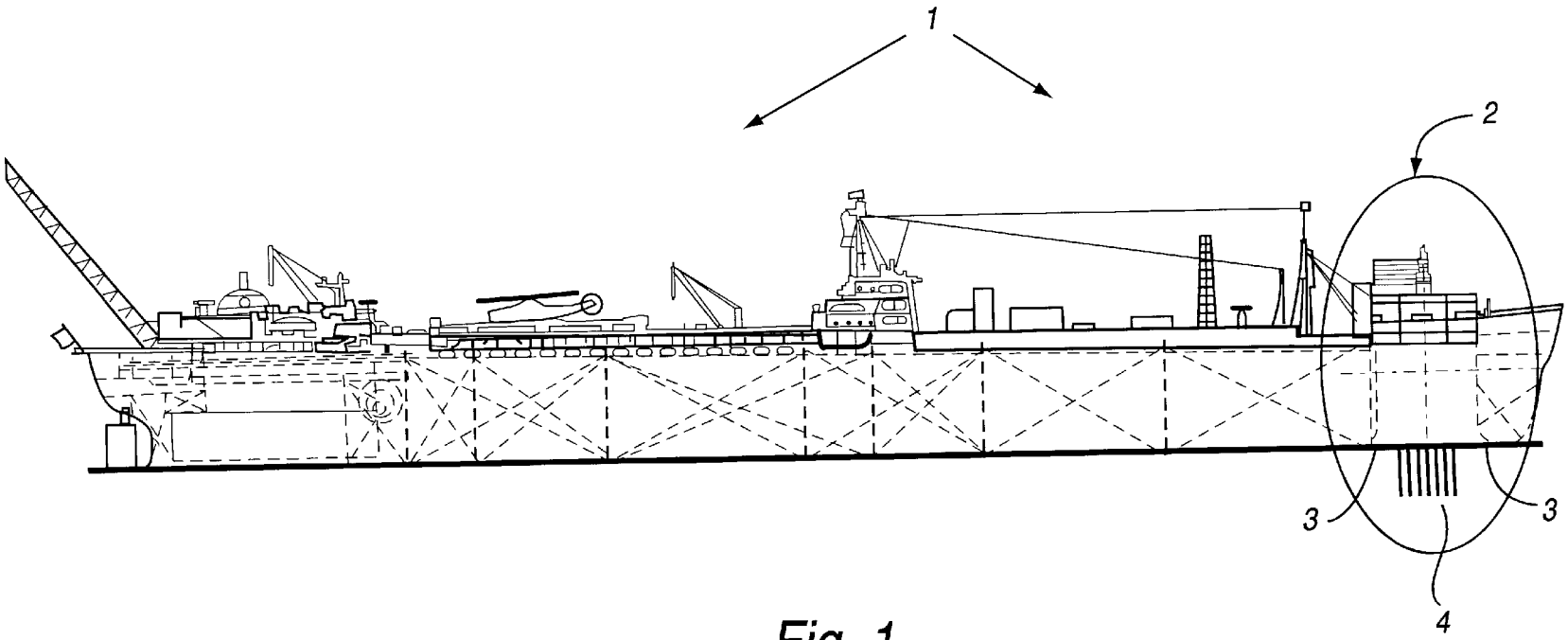
FIG. 1 shows a typical FPSO type floating production system, with the turret in the bow.

FIG. 1 shows a general view of an FPSO type floating production system (1). It can be observed that the turret (2) is positioned in the bow of the ship. The turret (2) is anchored, by means of anchorage lines (3), on the bottom of the sea. The ship can perform a rotational movement around the turret (2), which remains stationary. The fluids of the submarine system reach the turret (2) by means of vertical ascending tubes (4), which are also known to specialists as "risers". The main fittings of the turret (4) are rotary joints, which are also known to specialists as "swivel" joints, and which have the aim of making possible the transfer of fluids from the fixed risers (4) to the mobile vessel, which can rotate around the turret (2).

Figure 2:
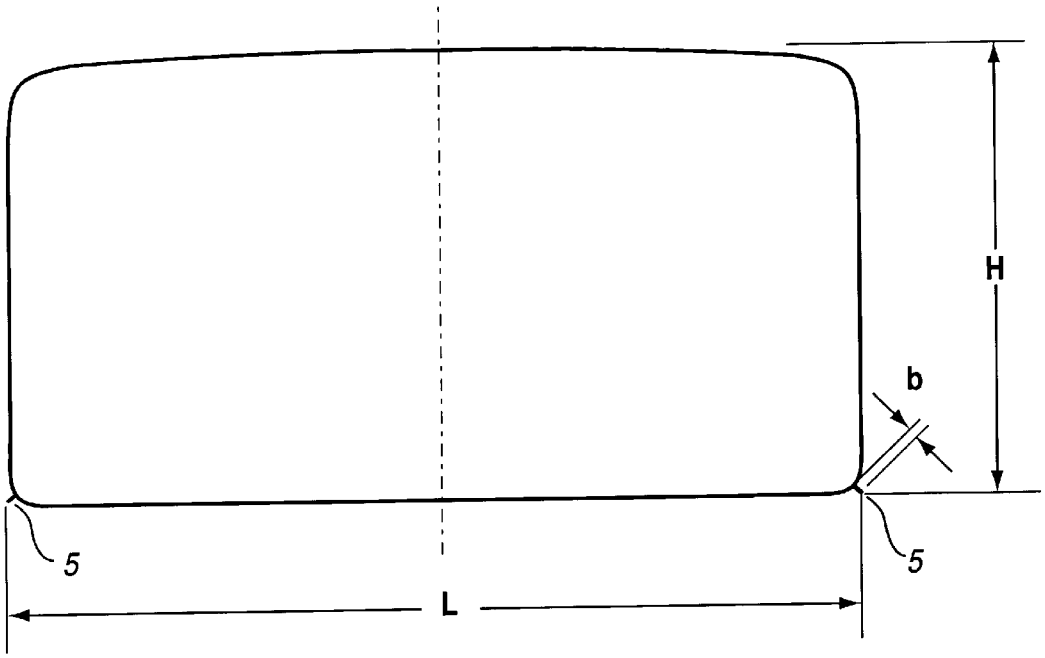
FIG. 2 shows the cross section of a typical oil tanker.

FIG. 2 gives a general idea of the relative dimensions of conventional bilge keels (5) in comparison with the cross section of a "J" Class oil tanker, as originally built. In the case of this example, the cross section presents a width, "L", of 43.13 m and a height, "H", of 23.20 m. Each side has five bilge keel sections (5) each with a length of 14.55 m (total 72.75 m) and a spacing of 2.45 m between them. The width, "b", of each bilge keel section (5) is 0.45 m, these being mounted at right angles to the hull of the ship, along the bilge, one on either side.

Figure 3:
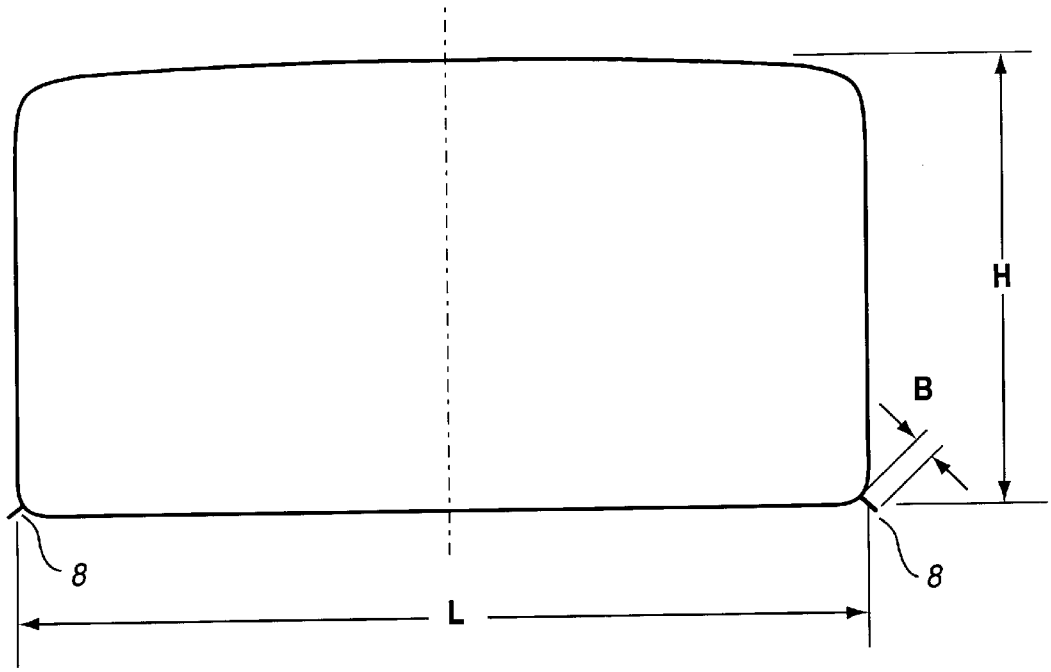
FIG. 3 shows the cross section of the same oil tanker as in the previous figure, but fitted with the bilge keel of the present invention.

FIG. 3 illustrates the cross section of the same oil tanker as shown in FIG. 2, adapted for use as an FPSO, fitted with the bilge keel (8) of this invention. It can be observed that the bilge keel (8) is mounted at right angles to the hull of the ship, in a similar way to the conventional bilge keels (5) shown in FIG. 2. However, the bilge keel (8) takes account of the fact that the FPSO (1) will be kept anchored, unlike ships which sail, thus resulting in important differences between the two embodiments.

In the case of the FPSOs, the supporting effect will be much less important. This effect is essentially proportional to the forward speed. For the FPSOs the forward speed to be considered will be that of the sea current, which is much less than the typical forward speed of ships. Thus, except for possible structural considerations, there is no reason to use bilge keels made up of various separate sections, with a large spacing between them, and it is possible to mount a continuous piece or to greatly reduce the spacing between the sections of the bilge keel.

In the case of FPSOs, continuous bilge keels also present the advantage over discontinuous bilge keels of increased resistance to any undesirable rolling movements (e.g. due to the ambient conditions). In order further to improve this effect, the continuous bilge keel can also be longer than conventional bilge keels. Finally, in order to increase the damping of the rolling caused by the incidence of the waves, the bilge keel is made wider i.e.—it projects away from the hull to a greater extent than the bilge keel of a ship normally travelling under its own power. Thus, the bilge keels for FPSOs, compared with the conventional ones, preferably have a larger surface area, are wider, continuous and cover a greater length of the ship.

The example of an embodiment of the invention shown in FIG. 3 is that of a bilge keel (8) for an FPSO (1), to be used in the same "J" Class hull as in FIG. 2. This continuous bilge keel (8) has a width "B" of 1.00 m and a length of 182.00 m on each side, compared with the 0.45 m width "b" and 72.75 m total length of the five sections of the discontinuous bilge keels (5) of the hull originally built.

Figure 4:
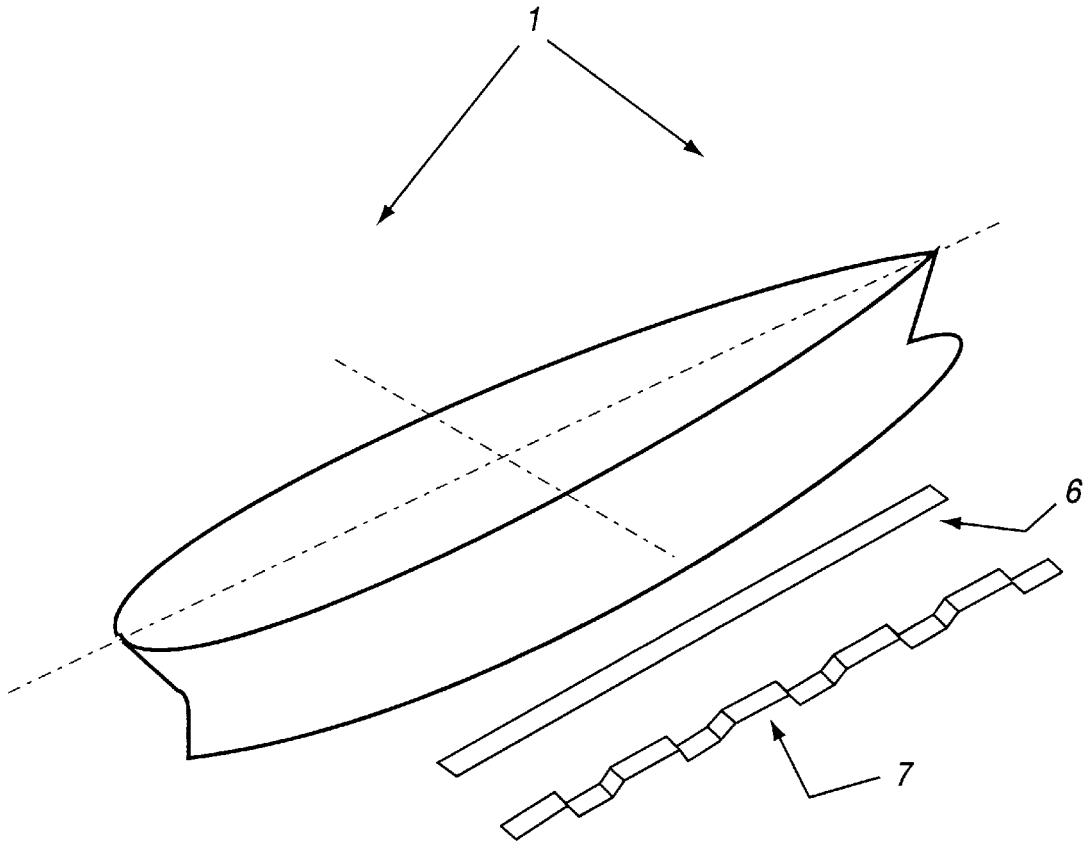
FIG. 4 shows two possible embodiments of this invention, in perspective.

As can be seen in FIG. 4, structural considerations may indicate it to be advantageous to construct the bilge keel (8) of the invention using corrugated plate(s) (7) instead of flat plate(s) (6). This type of plate (7) presents structural advantages, facilitating the mounting thereof on the hull of the ship. Additionally, it increases the resistance of the FPSO (1) to undesirable movements caused by winds or sea currents.

FIG. 3 also shows that the device of the invention does not need to have such a small width as that of the bilge keels of ships which sail, as the effect of its width on the forward speed does not need to be considered for the case of FPSOs. It is therefore possible to increase the width of the bilge keel (8) of the invention relative to the original bilge keel (5). Thus, the bilge keel (8) of the invention takes account of the fact that the FPSO (1) is anchored and not in transit, with the consequent low speed relative to the medium in which it is floating, due to the usual levels of current.

In short, it is ascertained that the invention, a bilge keel for FPSOs, typically consists of two lines of plates, of a considerably greater width than that of conventional bilge keels, placed at right angles to the hull thereof, one on either side, which extend along the bilge of the hull and not just along the parallel middle body thereof. The said lines of plates can be continuous or discontinuous, with a small spacing between each two consecutive sections, and the plates can be flat or corrugated. The main operational principle is to offer sharp edges to cause the generation of vorticity and thus create amplified moments proportional to the area of the bilge keel, which help to damp the roll. A secondary consequence, i.e. one which does not have major impacts on the resultant effect of the bilge keel for FPSO, is the increase in the additional inertia of the roll of the ship, which slightly alters the natural frequency of rolling. In some circumstances this fact may even be favourable. Another advantageous consequence for the application of the invention is the increase in the resistance to undesirable translational movements of the FPSO.

Although the invention is particularly advantageous in FPSOs obtained from adapting decommissioned ships, it can also be implemented in the hulls of floating facilities specially designed for FPSOs, especially when they have markedly elongated shapes.

The bilge keels of the present invention may be attached to the decommissioned ship by use of a method which also forms part of the present invention.

In one alternative form, the method of adapting a decommissioned ship comprises removing the existing bilge keels and replacing them with bilge keels having a larger surface area by virtue of their greater width and/or total length. Another method involves extending the existing bilge keels by means of attachments fixed thereto. This method saves on both materials, costs and time to complete the adaptation.

The efficacy of the present solution was verified by means of tests. Trials with models are considered effective for dimensioning bilge keels. It is possible to make models of vessels of sufficient dimensions to minimize the "scale effect". Bearing in mind the sharp edges provided by the bilge keel, the separation of the boundary layer is caused in a similar way to that which happens on a real scale.

Decay tests and tests in regular waves were performed for subsequent comparison with the results of the WAMIT Program (MIT 95), a standard industrial program for study of the movements of floating bodies interacting with the free surface.

The decay test involves subjecting the hull to an initial static roll angle (in this case, of the order of 12 degrees) and then releasing the model for free oscillations. The time domain series of the resultant no movements is duly recorded, providing means of quantifying the viscous damping. In cases when linear differential equations were used, the peaks of the oscillations follow an exponential law. In the non-linear case, a greater damping was noted. For small amplitudes the rolling tends to be only slightly damped.

The test in regular waves involves subjecting the hull to the impact of regular waves at an angle of 90 degrees. Such waves are of various periods and heights, producing different responses from the hull. The ratio of the response amplitude of the roll to the amplitude of the wave is called the RAO (Response Amplitude Operator). For the linear case the RAO curve is unique, but for the non-linear case the ordinates may depend on the wave amplitude. In order to help quantify the damping for various conditions or bilge keel configurations it is possible to use the WAMIT Program (MIT 95), which actually takes account of the linearized viscous damping but even so, as illustrated below, can provide data to facilitate the quantification of the damping.

Table 2 summarizes the results obtained for the Damping Coefficients, inferred from tests for a Class J in a test tank, in comparison with processing by the Program. Table 1 shows the characteristics of the keels tested.

TABLE 1

| BILGE KEEL | LENGTH (m) | SPACING (m) | WIDTH (m) |
|---|---|---|---|
| 1 (original) | 72.750 (5*14.550) | 2.425 | 0.450 |
| 2 | 182 | — | 0.450 |
| 3 (for FPSO) | 182 | — | 1.000 |

TABLE 2

| | HEIGHT OF WAVE (m) | | |
|---|---|---|---|
| BILGE KEEL | 1.5 | 1.9 | 3.5 |
| 1 (original) | 0.062 | 0.076 | 0.121 |
| 2 | 0.080 | 0.094 | 0.140 |
| 3 (for FPSO) | 0.121 | 0.144* | 0.194* |

*estimated from results with other bilge keels

The results obtained indicate that in spite of the fact that the final value of the damping depends on a complete understanding of the non-linear movement in conjunction with the analysis of decay tests, the above considerations are justified insofar as they serve as a comparison between the cases analyzed. Thus, the inference the bilge keel for FPSO is twice as effective as the original bilge keel is not far from the truth.

Finally, it can be affirmed that for cases of FPSOs that can receive waves laterally, the use of the invention can make using decommissioned ships a viable undertaking. Otherwise, other floating facilities less sensitive to excitation by rolling would have to be considered meaning a significant increase in the cost of the undertaking.

What is claimed is:

1. A method of adapting a decommissioned ship to control rolling for FPSO purposes, said method comprising providing said ship with an FPSO bilge keel having at least one of a greater average width than an average width of an original bilge keel of the ship and a greater total bilge keel length than a total original bilge keel length of the ship.

2. A method according to claim 1 wherein said original bilge keel is removed before said FPSO bilge keel is attached.

3. A method according to claim 1 wherein said step of providing an FPSO bilge keel comprises attaching at least one extra portion to said original bilge keel.

4. A method according to claim 1 wherein said step of providing an FPSO bilge keel comprises mounting two lines of plates at right angles to the hull at respective bilge portions of said ship.

5. A method according to claim 4 wherein said step of mounting comprises mounting said plates continuously in each line and wherein each line is approximately identical.

6. A method according to claim 4 wherein said step of mounting comprises mounting said plates discontinuously in each line, each line being made up of more than one section with a separation between each section, said separation being smaller than a separation between two original bilge keel sections on the ship.

7. A method according to claim 4 wherein said step of mounting comprises mounting corrugated plates.

8. A ship comprising a bilge keel, said bilge keel being mounted along a bilge of said ship and having at least one of a greater total length than a total length of an original bilge keel of the ship and a greater average width than a total average width of the original bilge keel of the ship.

9. A ship according to claim 8 wherein said bilge keel is made up of two lines of plates which are adapted to be mounted at right angles to said ship bilge.

10. A ship according to claim 9 wherein said plates are continuous in each line and each line is approximately identical.

11. A ship according to claim 9 wherein said plates are discontinuous in each line, each line being made up of more than one section.

12. A ship according to claim 11 wherein there is a separation between each section, said separation being smaller than the separation that originally existed between two original bilge keel sections of the ship.

13. A ship according to claims 8, wherein said plates are corrugated.

14. A decommissioned ship adapted to control rolling for FPSO purposes by providing said ship with an FPSO bilge keel having at least one of a greater average width than an average width of an original bilge keel of the ship and a greater total bilge keel length than a total original bilge keel length of the ship.

* * * * *